United States Patent [19]

Hall et al.

[11] 3,957,287

[45] May 18, 1976

[54] BOOK AND COVER THEREFOR

[75] Inventors: Lewis William Hall, Lancaster; Joseph E. Wisotzkey, York, both of Pa.

[73] Assignee: The Maple Press Company, York, Pa.

[22] Filed: June 7, 1972

[21] Appl. No.: 260,356

Related U.S. Application Data

[63] Continuation-in-part of Ser. No. 196,101, Nov. 5, 1971, abandoned.

[52] U.S. Cl. ..... 281/21 R; 281/29

[51] Int. Cl.[2] ..... B42D 1/04; B42D 3/00

[58] Field of Search ..... 281/29, 21 R, 28, 20, 281/36, 34

[56] References Cited

UNITED STATES PATENTS

| | | | |
|---|---|---|---|
| 231,067 | 8/1880 | Loveridge | 281/29 |
| 653,393 | 7/1900 | Page | 281/34 |
| 2,180,965 | 11/1939 | Palmer et al. | 281/29 X |
| 3,088,753 | 5/1963 | Sendor | 281/29 |
| 3,532,363 | 10/1970 | Abildgaard et al. | 281/29 |
| 3,744,821 | 7/1973 | Abildgaard et al. | 281/29 X |

FOREIGN PATENTS OR APPLICATIONS

| | | | |
|---|---|---|---|
| 1,009,441 | 11/1965 | United Kingdom | 281/29 |
| 1,160,975 | 8/1969 | United Kingdom | 281/29 |
| 424,774 | 2/1935 | United Kingdom | 281/29 |

*Primary Examiner*—Jerome Schnall
*Attorney, Agent, or Firm*—C. Hercus Just

[57] ABSTRACT

A book cover formed from synthetic resin and comprising a unitary rectangular sheet having an intermediate back panel integrally connected to cover panels, the intermediate back panel being more flexible than the cover panel and adapted to extend across and be adhesively connected to the spine of a book to form a complete book. Headbands of limited thickness are provided at opposite ends of said intermediate back panel to position the spine of a book therebetween and said cover also being provided with thin flexible hinge portions that connect the back panel to the inner edges of each of the cover panels.

8 Claims, 14 Drawing Figures

INVENTORS
Lewis William Hall
BY Joseph E. Wisotzkey
ATTORNEY

INVENTORS
Lewis William Hall
BY Joseph E Wisotzkey
ATTORNEY

INVENTORS
Lewis William Hall
BY Joseph E. Wisotzkey
ATTORNEY

BOOK AND COVER THEREFOR

This application is a Continuation-in-Part of application Ser. No. 196,101, filed Nov. 5, 1971, now abandoned.

SUMMARY OF THE INVENTION

Historically, for a number of centuries, the most common form binding has comprised so-called hard covers which inlcude a board stiffener, the outer surface thereof being covered with a sheet of cloth or other suitable material which is firmly adhered thereto and wrapped around the edges thereof for attachment by adhesive at least to the edges of the opposite surface of the board stiffener. Said opposite surface of the stiffener then is covered by an end sheet which extends nearly to the edges of the inner surface of the board stiffener and overlies the inturned edges of the end sheet.

Such cover is attached to a book which, in the publishing trade, comprises a group of connected signatures or pages. The folded edges of the signatures or page edges are sewn or otherwise secured together and said edges are also sometimes reinforced by a strip of crash, which is similar to cheesecloth, that is glued across the closely compacted folded and secured edges of the signatures or pages, followed by a strip of durable kraft paper being glued upon the crash. The crash material extends a limited distance along the first and last pages of the book, and is glued to the inner surfaces of the board stiffeners and is hidden by the end sheet which is glued thereover, as well as extending across the first and last pages of the book to also constitute cover sheets therefor. Obviously, manufacturing binding of this type is relatively expensive. When not including a substantial number of hand operations, such binding requires the use of expensive automatic machinery.

For purposes of being able to publish popular books at relatively low cost in the current market, so-called "paperback" books have become very popular. The covers for such books merely consist of a sheet of paperstock or modified paperstock which usually is of stiffer and thicker nature than the leaves or pages of the book, and thereby is more durable, than such pages which the cover encloses. The cover is glued to the spine of the book in a very simple manner. The hinge of the cover panels of such a cover are no more durable than the nature of the stock from which the cover is formed. Such paper stock also is subject to relatively ready tearing and mutilation, especially when handled roughly.

Without restriction thereto, the textbook field of publishing has, in particular, been seeking books which have bindings thereon that are much more durable than the bindings or covers on said aforementioned paperback books, yet are less expensive than so-called hard covers of the type first described above. To supply this demand, efforts have been made in recent years to utilize certain types of plastics or synthetic resins as covers. One of the difficulties encountered in attempting to employ resinous materials of such type has been the need to eliminate or at least minimize the tendency for plastic memory of the material to restore a sheet of plastic to flat condition. It can be understood that when a sheet of plastic, for example, is secured by adhesive to the spine of a book and the covers are bent around the edges of the spine, if the book lies flat upon one cover, there is a tendency for the opposite cover to move upwardly from the uppermost page of the book due to the memory of the plastic from which the cover is formed to restore the same to sheet-like or flat condition.

One relatively complex proposed solution to the making of book covers from synthetic resin comprises the subject matter of U.S. Pat. No. 3,532,363, issued Oct. 6, 1970, in the name of W. H. Abildgaard et al. The process contemplated by said patent includes the molding of a cover sheet comprising cover panels which constitute major opposite end portions of the sheet and these are connected by an intermediate portion which is heated by a heater to melt it and then apply an intermediate strip thereto. While said strip is still in viscous condition, the spine of the book is forced into the viscous material which fills any of the unevennesses in the paper edges of the spine and bonds all of the edges to themselves and the intermediate portion of the cover. Grooves are also formed in the inner surfaces of the cover sheet where the intermediate portion joins the cover sheet so as to form hinges. However, the problem of memory of the material is not solved by such procedure. In addition, very extensive, elaborate equipment is required to form the covers and effect the connection thereof to the spine of a book in accordance with the disclosure of said patent.

U.S. Pat. No. 2,486,330, issued Oct. 25, 1949, in the name of F. S. Schade, proposes the use of a plastic cover for books in which stiffening sheets are inserted between opposite panels of plastic sheet material, whereby said stiffening members are covered on both sides by the plastic material. From the standpoint of economy, such arrangement does not minimize production cost, nor are satisfactory means provided for securing the spine of a book to the cover.

U.S. Pat. No. 3,206,225, issued Sept. 14, 1965, in the name of D. A. Oleson, is directed to the making of relatively simple book-like products, such as menus, wine lists, etc., in which printed paper sheets are encased between two sheets of durable, self-hinging laminated plastic sheets by thermolamination and provided only with a single fold. Such structure offers little by way of suggestion for solving the current need for durable plastic or synthetic resin sheet covers for books of conventional type which are composed of a plurality of signatures of printed paper pages.

In an attempt to fill the void of an acceptable, relatively inexpensive plastic or synthetic resin cover for a book comprising a plurality of connected signatures of printed pages, which cover is capable of being applied to the spine portion of such a book by machines which presently are available, including some of those presently used in the affixing of paper bindings or hard covers to books, the present invention has been developed and extends along lines which depart to varying degrees from accepted practices and book cover constructions known to exist at present or heretofore used.

In short, the basic principle employed in the concept comprising the present invention is to provide various thicknesses in a sheet of plastic which may be formed into a book cover either by being injection molded; compression molded, thermoformed, such as by heating a sheet of sythetic resin of uniform thickness and pressing the same between suitable dies to provide the desired configuration in one or both surfaces thereof; coextruding strips of additional thicknesses of synthetic resin onto a base sheet of suitable thickness; mechanically contouring sheet resin material, as required, by cutting or abrading machines; utilizing sheets of relatively stiff foam resin material of suitable thickness to form the cover panels and compressing the same at locations where thinner dimensions are required; and by extruding fluid resin in a plurality of ways to form and stabilize a surface-contoured strip to be cut into individual covers. The present invention is particularly concerned with the characteristics of the sheet in the area which is applied to the spine of the book and the adjacent areas which comprise the hinge means for the cover panels of the books.

It is particularly important that a book cover be formed in such manner that the book will lie in open position when one of the covers and one part of the book are moved to open position, for example, from the other cover and other part of the book. In addition, it also is desirable that, if possible, the book may be opened anywhere desired between a pair of adjacent pages and the open portions then may be folded backward upon themselves, each being moved substantially 180° from the closed position of the book, without injurying the spine portion of the cover or the spine of the book, depending upon the nature of the spine of the book, whereby either one of the exposed pages readily may be held in substantially flat condition for reading.

The selection of suitable synthetic resin from which the improved cover may be formed also is important, not only for durability, especially in the hinge areas, but also in order that, in particular, the outer surfaces of the cover may be suitably prepared to receive decorative effects, imprinting, and the like by a relatively simple means such as flame impingement, or corona discharge, by which the surface of the resin is oxidized for the acceptance of not only decorative means and desired imprinting, but also to render the surface which is adhered to the spine of the book suitable for the acceptance of appropriate adhesives in order to form a firm connection of the cover to the book.

Details of the improved characteristics set forth above are achieved by the following procedures and structural details comprising novel aspects of the present invention.

SUMMARY OF THE INVENTION

It is the principal object of the present invention to utilize preferably an appropriate polyolefin resin or mixtures thereof to form a substantially rectangular sheet-like cover member by appropriate means such as by being injection molded, compression molded, thermo-formed, co-extruded, mechanically contoured, appropriately compressing foam resin sheet material, or extruding fluid resin in ways to form surface contoured strips of cover material to provide an intermediate back panel portion integral with and midway between cover panels at opposite ends of the sheet, the back panel and the portions of the sheet adjacent opposite edges thereof being provided with various thicknesses to form hinge portions, as well as strips or elongated areas adapted to receive adhesive by which the back panel may be secured to the spine surface of the book and edge portions of the end sheets.

It is another object of the invention to form said back panel so as to be thinner than the cover panel, whereby the panel may be applied either to a substantially flat or curved spine surface of a book with equal facility.

It is a further object of the invention to provide the thinner back panel with a width that is greater than the thickness of the book, whereby the opposite edges of the thinner back panel may be bent around the edges of the spine of the book when applied thereto in order that limited areas of the sides of the book likewise may be adhesively connected to said thinner back panel and, due to the greater width of the back panel than the thickness of the spine, a limited range of different thicknesses of the spines of books may have said back panel of the cover applied thereto and thereby minimize the inventory of different sizes of book covers which will be required to provide covers for a substantial overall range of different thicknesses of books.

It is a still further object to utilize the outer edge portions of said thinner back panel as lands which may be scored along the surface, as that which is to be applied to the spine of the book, said scorings being formed at the line of bend where said lands are wrapped around the outer edges of the spine onto the sides thereof.

It is still another object of the invention to provide narrow and thicker securing panels adjacent the opposite edges of the thinner back panel of the cover at locations beyond the lands of said back panel for the application of adhesives thereto to secure the cover to relatively narrow, elongated areas on the sides of the book immediately adjacent the spine thereof.

A still further object of the invention is to provide thin hinge portions respectively in the cover between said securing panels and the cover panels.

Still another object of the invention is to provide said cover with narrow headbands which are formed integrally with the opposite ends of the back panel of the cover, on the inner surfaces thereof, said headbands preferably being no longer than the thickness of the book for the primary purposes of (1) serving as positioning means for locating the spine of the book longitudinally with respect to the cover when connecting the same thereto and (2) reinforcing the opposite ends of said thinner back panel to withstand customary use.

One additional object of the invention is to form the book cover by molding synthetic resins of the type described so as to have one substantially continuous flat surface, while the opposite surface is provided with areas of various thicknesses comprising the cover panels, thinner intermediate panel, securing panels, hinge portions and the headbands.

Ancillary to the immediately foregoing object, it is a further object that the headbands may be molded on the otherwise substantially continuously flat surface of the cover under circumstances where such flat surface is to be disposed innermost and thereby overlie the spine and sides of the book to which the cover is connected.

Details of the foregoing objects and of the invention, as well as other objects thereof, are set forth in the following specification and illustrated in the accompanying drawings, comprising a part thereof.

DETAILED DESCRIPTION

Figure 1:
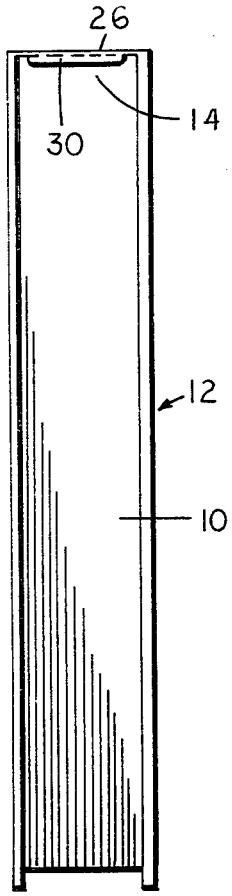
FIG. 1 is an end view of a book to which a cover embodying the principles of the present invention has been affixed.
Figure 2:
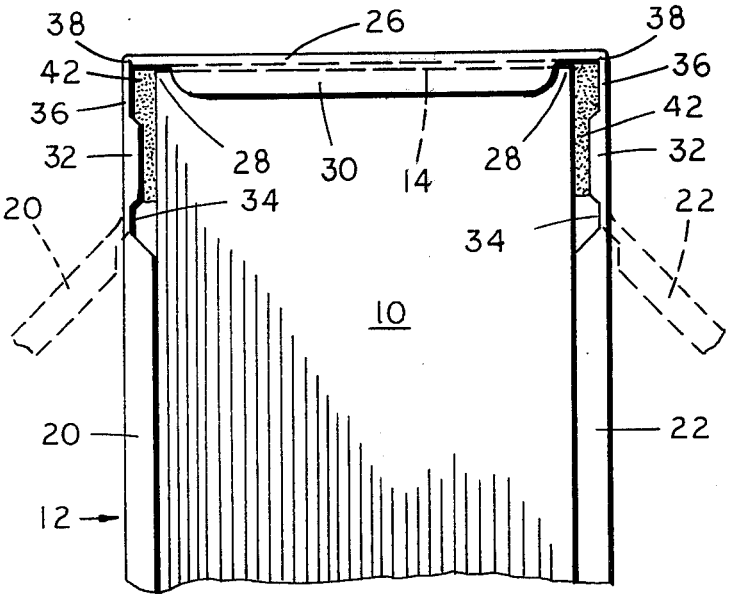
FIG. 2 is a fragmentary end view of the back portion of the book shown in FIG. 1 and illustrated in a larger scale to show certain details of the invention to better advantage, fragmentary portions of the cover panels of the book being illustrated in phantom in partially open condition.

Referring to FIG. 1, the book 10 is shown mounted within a cover 12 embodying the principles of the present invention. It is to be understood that the book 10 comprises an exemplary assembly of a plurality of signatures each composed of a number of leaves or pages. Such assembly in each signature is folded in the middle and the folded ends of all of the signatures are connected together in any of a number of ways well-known in the book publishing industry. For example, without restriction thereto, the signatures may be connected together by being sewn, adhesive bound, side stitched or side wire-stapled. Therefore, the book 10 comprises a plurality of connected pages and is representative of any of the aforementioned types or methods of connecting such pages.

Figure 3:
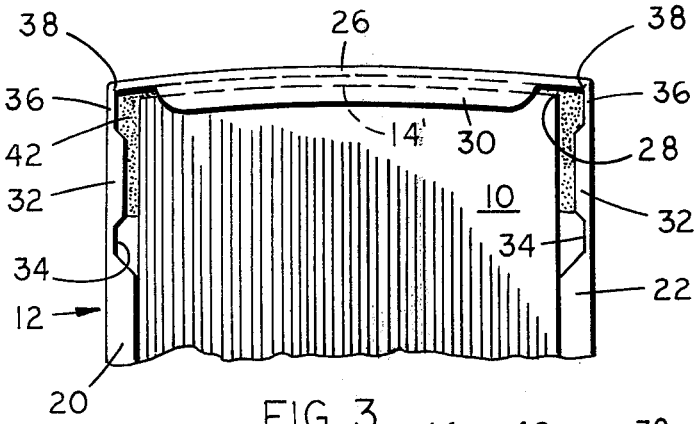
FIG. 3 is a view similar to FIG. 2 but showing the cover applied to an outwardly curved spine of a book.
Figure 5:
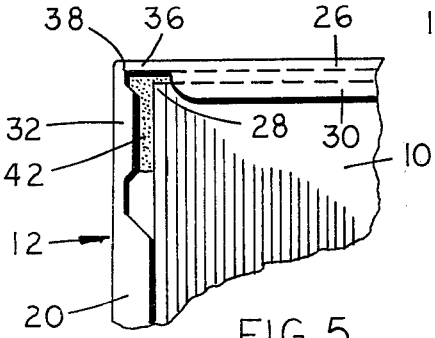
FIGS. 5 and 6 are fragmentary views of the upper left-hand corner of the book shown in FIG. 2 and respectively illustrating books of different thicknesses accommodated by the same cover, the book in FIG. 5 being thicker than the book in FIG. 6.

In addition, the assembled pages of the book 10 may be arranged in the configuration of a flat back, in which all of the signatures in the spine 14 are arranged in a substantially flat transverse plane, or as shown in exemplary manner in FIG. 3, the spine 14′ may be of a curved nature, said curvature in said figure merely being exemplary of one type of curve and other curvatures of the backs or spines of the book may have the cover 12 of the present invention applied thereto with equal facility.

Figure 12:
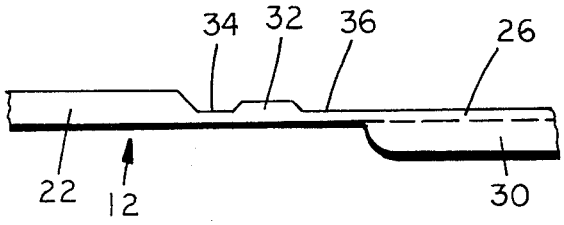
FIG. 12 is a fragmentary view of a portion of a book cover similar to that shown in FIG. 9 but illustrating the head-band applied to the opposite surface of the cover to that shown in FIG. 9.
Figure 13:
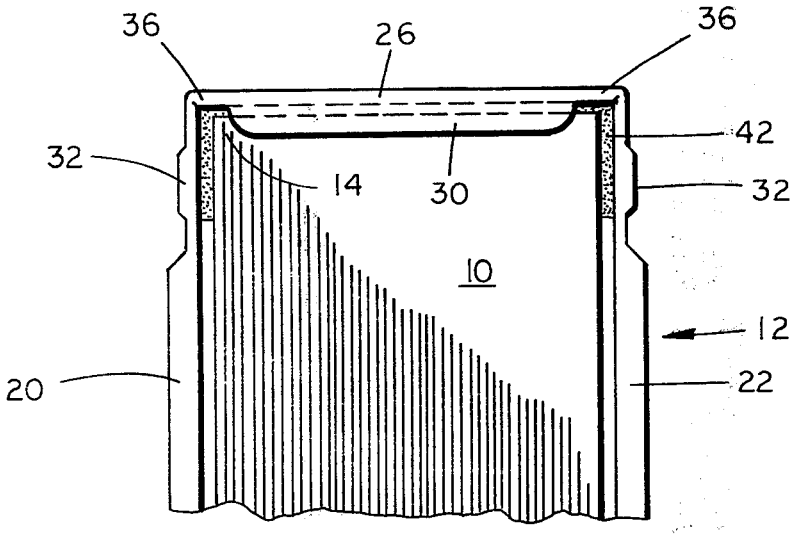
FIG. 13 is a fragmentary end view of a book to which the embodiment of cover shown in FIG. 12 has been applied.

The cover 12 may be formed in one of a number of different ways in accordance with the present invention. One embodiment of cover 12 is shown in FIGS. 1–3 and 5–10. A slightly modified embodiment is illustrated in FIGS. 12 and 13. Still other embodiments of means for forming the covers are shown in FIGS. 14–28. Details of these various embodiments and means for forming them are set forth hereinafter.

Figure 7:
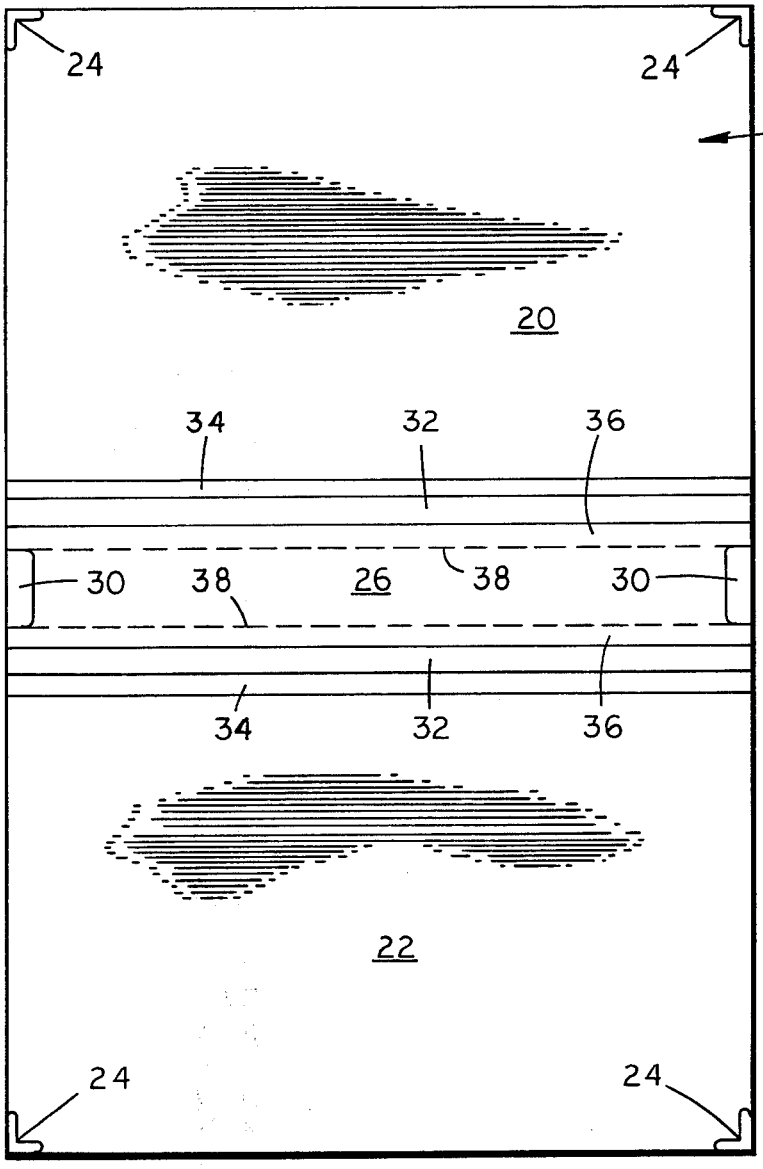
FIG. 7 is a plan view of a book cover embodying the principles of the invention and showing the surface which is preferably applied against the spine and side of a book.

Referring to the embodiments shown in FIGS. 1–3 and 5–10, a substantially rectangular sheet of synthetic resin is formed in the exemplary shape shown in plan view in FIG. 7. The synthetic resins which are preferred for use in making the cover 12, in general, are the polyolefins, but this is exemplary rather than restrictive. These include, for example, polyethylene, polypropylene, poly 1-butene and mixtures, co-polymers or block co-polymers of any two or more polyolefins. The reason for selecting the polyolefins in general is because their durable nature renders them capable of sustaining extensive numbers of flexed bendings, especially at the hinge portions of the cover and still maintain connection of the cover panels with the back or spine panel, for example, which extends across and is secured to the spine of the book 10. Of the compounds mentioned, either high density polyethylene or crystaline polypropylene are preferred for greatest durability.

In addition, other synthetic resins which are suitable for use with the present invention include: acrylonitrile-butadiene-styrene (ABS) and polymers, copolymers, block polymers and graft polymers thereof; polyvinyl polymers; polyvinylidene chloride polymers and expanded vinyl polymers and the like.

The covers 12 shown in FIGS. 1–3 and 5–10 also preferably are formed individually and are capable of being arranged in stacked form in suitable support means in a bookbinding machine so that, for example, the lowermost cover in the stack may be removed successively for application to the leading book of a series of books fed along an assembly line in a bookbinding machine, for example, not shown.

As briefly referred to hereinabove, the individual covers referred above may be formed by any one of a number of different conventional plastic molding machines, including injecting said covers into appropriate mold dies having the desired cavity configurations in the opposite surfaces thereof, compression molding the covers between dies in a plastic compression molding machine having the required configurations in the die surfaces, or thermo-forming the covers from sheets of suitable plastic or synthetic resin by heating the sheet material and then pressing it between pressing heads having desired surface configurations therein adapted to impress the opposite surfaces with the desired configurations which are required to be formed upon the covers thus formed in the machines. It is to be understood that the foregoing examples of means to form the covers are intended to be exemplary rather than restrictive. Still other procedures for forming such covers suitably are described hereinafter relative to FIGS. 14–20.

Figure 8:
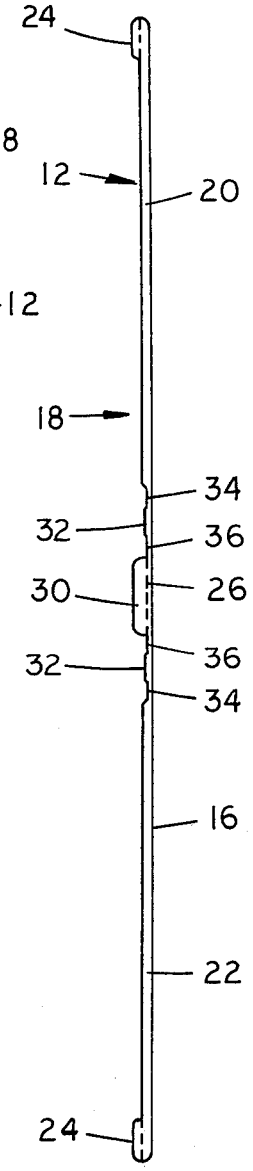
FIG. 8 is an end elevation of the cover shown in FIG. 7.

Regardless of the type of machine in which the covers are formed and the process used to form the same, the embodiments of covers such as shown, for example, in FIGS. 1–10, all have a substantially smooth, flat, outer surface 16 which is best illustrated in FIG. 8 which comprises an end elevation of the exemplary cover 12. The opposite surface 18 has a number of different elevations formed thereon for purposes of providing opposite cover panels 20 and 22 which are substantially identical to each other and are of uniform thickness, except for the corners that, preferably, are provided with flat, reinforcing projections, which are illustrated in exemplary manner as being L-shaped in plan view. Said projections not only reinforce the corners of the cover panel to resist bending but also, in conjunction with other means to be described hereinafter, they cooperate with means of the feeding mechanism to sequentially remove the lowermost cover, for example, from a stack thereof in a binding machine in which the covers 12 are fed for application to books 10, for example.

The cover panels 20 and 22 are connected together by connecting means extending between the inner edges of said cover panels and including a central intermediate back panel 26, the outermost portions of which comprise lands 36 and narrow securing panels 32 are connected respectively to the outer edges of said lands. Portions of said connecting means immediately adjacent the inner edges of said cover panels and said securing panels are thinner than said cover and securing panels and comprise hinge means 34 therebetween, all of which are described in detail hereinafter. Also, the back panel 26 is substantially thinner than the cover panels 20 and 22, as readily can be seen from FIGS. 2–6 and especially FIG. 9. The thickness of said back panel is selected so as readily to conform to the back or spine surface of the book 10 and, in particular, to permit creasing or folding the back panel around the outer edges 28 of the book so that in conjunction with the adhesive, there is substantially no residual tendency for the plastic memory of the material from which the cover is formed to tend to restore the back panel 26 to flat condition after it has been bent and extended along the edges of the spine and onto the sides of the book adjacent the spine 14. Additional means, described hereinafter, also further minimize such tendency.

In the embodiment of the cover 12 shown in FIGS. 1–3 and 5–9, the opposite ends of the intermediate back panel 26 are provided on the inner surface thereof, which is uppermost as viewed in FIG. 7, with similar, relatively narrow headbands 30, which are molded integrally with the back panels 26 at the time the same are formed in conjunction with the cover panels 20 and 22, thereby being composed of the same resin material from which all other parts of the cover 12 are formed. From FIG. 7, in particular, it will be seen that the headbands 30 are of limited width in a direction longitudinally of the back panel 26.

Essentially, said headbands have three principal functions. One is to provide locating means between which the spine of the book 10 is oriented longitudinally with respect to the back panel 26 of the cover 12. It is to be understood that the inner edges of the pair of headbands 30, as viewed in FIG. 7, are spaced apart a distance slightly greater than or substantially equal to the length of the back or spine 14 of the book 10. Further, the length of said headbands in directions transverse to the longitudinal axis of back panel 26 is preferably no greater than the thickness of the book which is to be applied to any individual cover. Under some circumstances, it may be found desirable, or useful, to employ only a single headband, preferably at the top of the book.

A second function of the headbands 30 is to strengthen the relatively thin nature of the back panel 26, particularly in regard to grasping the upper end of a book, when placed vertically upon a book shelf, by engaging the upper end of the back panel 26 with a finger or fingernail incident to removing the book from the shelf, as well as provide strength to the lower end of the back panel when a book is standing on a shelf. Exemplary thicknesses of the various portions of the cover 12 are set forth hereinafter.

A third function of the headbands 30 is to provide means which readily may be engaged by feeding mechanism, for example, incident to removing the lowermost cover from a stack thereof in a bookbinding machine in which the covers are stacked with the headbands 30 lowermost. Under circumstances where the headbands 30 cooperate with the corner projections 24 to space successive covers in a stack equally from each other, it is preferred that the overall thickness of the corners of the cover 12 should be substantially equal to the combined thickness of the headband 30 and the back panel 26 to which they are connected.

Figure 9:
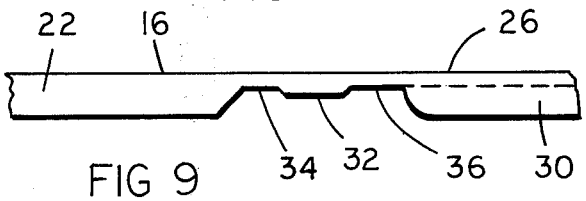
FIG. 9 is a fragmentary end view of a portion of the left-hand side of the cover shown in FIG. 7, as viewed with the smooth surface uppermost, and illustrated on a larger scale than employed therein.

Another important feature of the cover 12 is the provision of relatively narrow, elongated securing panels 32 which are thicker than the back panel 26 but preferably thinner than the cover panels 20 and 22 as is best shown in FIG. 9. In a transverse direction, as viewed in FIGS. 8 and 9, in particular, it will be seen that the securing panels 32 are spaced laterally from the opposite ends of the headbands 30. The panels 32 also are integral with the cover 12 and are formed incident to the molding of all of the other elements of the cover. One edge of each securing panel 32 is connected by a thin hinge portion, formed by hinge groove 34, to the inner edge of each of the cover panels 20 and 22. The opposite edge of each of the securing panels 32 is integrally connected to a land strip 36 which actually is a continuation of the intermediate back panel 26, said lands preferably being of the same thickness as said back panel, whereby they are thin and readily flexible. They also comprise an important feature of the present invention for the following reasons:

For purposes of minimizing the inventory of molds and, correspondingly, of different sizes of book covers which must be manufactured for application to books of a substantial range of thicknesses; for example, from ⅜ inch to 1½ inches, the lands 36 along opposite edges of the back panel 26 are of sufficient width that they may be bent or creased along exemplary lines 38 which are immediately adjacent the outer edges 28 of the book 10. Referring to FIG. 7, it will be seen that said crease line may occur within a limited range of locations within the land 36 between the ends of the headband 30 and the adjacent edge of the securing panel 32, as viewed in FIG. 9, for example. The width of said lands is made adequate to accommodate a range of variations in thickness of a book of approximately at least ⅛inch. The manner in which the lands 36 accommodate such variations in thickness of the book is illustrated in exemplary manner respectively in FIGS. 5 and 6 in which the book is thicker in FIG. 5 than the book in FIG. 6, whereby it will be seen in FIG. 5 that a lesser amount of the lands 36 extends longitudinally along the side of the book than in the arrangement shown in FIG. 6.

By way of example only, it is indicated that a set of molds may be formed, for example, wherein the distance between the innermost edges of the securing panels 32 respectively may vary by increments of ⅛inch. Correspondingly, the length of the headbands 30 may vary in each of the molds respectively by the same extent, whereby the width of the lands 36 will be substantially the same in all of the molds, it being understood that said lands extend in a lateral direction only between the inner edges of the securing panels 32 and the adjacent ends of the headbands 30 as viewed in FIG. 9.

Figure 10:
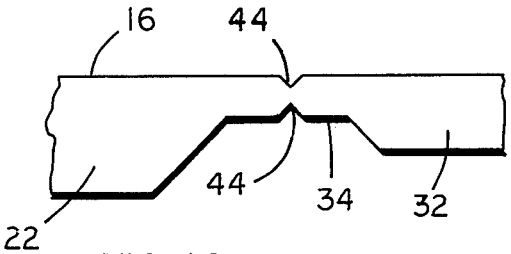
FIG. 10 is a fragmentary further enlarged portion of the end view of the cover shown in FIG. 9 to illustrate additional details therein.

With respect to the thickness of the various areas, sections and panels of the cover 12, by way of example only and not restriction, it is indicated that the certain types of polyolefins, and especially the types of polypropylene and polyethylene referred to hereinabove, may be approximately 0.030 inches thick in the cover panels 20 and 22; substantially 0.016 or 0.015 inches thick in the securing panels 32; and approximately 0.010 inches thick in the back panel 26, as well as in the land strips 36 and the hinge sections formed by the grooves 34. In particular, such exemplary thickness for the back panel 26 and land strips 36 has been found to be especially suitable to adapt the back panel 26 to either a flat or curved spine surface of a book. In reality, such thickness of the back panel renders it quite thin but especially the types of polypropylene and polyethylene referred to above are sufficiently tough and resistant to abrasion and tearing, as well as flexible, that they have been found to be fully adequate for such use, especially when the outer ends of the back panel 26 are reinforced by the headbands 30. Further, if desired, the relatively flat groove hinge portions 34 of the cover may have small grooves 44 formed appropriately therein, if necessary to provide greater flexibility than otherwise is inherent in such hinge, as shown in FIG. 10.

Figure 2A:
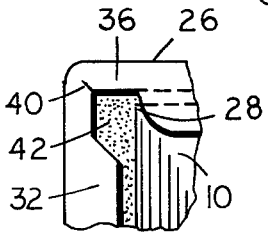
FIG. 2A is a fragmentary view of the upper left-hand corner of the book and cover shown in FIG. 2 and illustrated in a larger scale in order to show further details of the cover structure.

Of equal importance is the fact that such thickness for the land strips 36 renders them highly capable of being bent sharply, such as at a right angle, around the opposite edges of the spine 14 of the book 10 without having any extensive tendency for plastic memory in the material to restore the same to flat condition in which the cover initially was formed. To further discourage any tendency for the land strips 36 to restore themselves to flat condition, by reference to FIGS. 2A, it will be seen that the inner surface of the land strip 36 may be provided with a score line 40 of limited depth and formed in any suitable manner, such as either by shallow cut or impressed into the surface by a blade or wheel. Such operation may be performed, for example, at the same time the inner surface of the cover is being treated to facilitate the adherence of adhesive thereto, such as by being subjected to flame impingement or corona discharge which oxidizes the surface. Also, the outer surface of the cover 12 may be similarly treated to render the surface thereof readily susceptible to printing or otherwise forming decorations, words and numerals upon such surface by conventional commercial practices, including the application of metallic foils and otherwise to such outer surfaces.

The cover 12 is attached to the book 10 be an appropriate cement of which a number of commercial types are available. One type which has been found to be suitable is a white cold resin adhesive manufactured by the Borden Company and identified as Borden E1576-B. Hot melt resin-base adhesives also may be used, as well as others, as long as they have suitable adherence properties with respect to the resin from which the cover is formed and the outer surface of the spine and end papers, if such end papers are used, or the first and last pages of the book 10. Referring to FIGS. 2–6, it will be seen that the adhesive 42 is disposed between the spine of the book and the inner surface of the back panel 26, the securing panels and the opposite sides of the book adjacent the spine thereof, and also between the land strips 36 and the adjacent corner areas of the spine of the book.

In said figures, the thickness of the adhesive and the spaces in which it is located have been substantially exaggerated to render the same more readily apparent, rather than by using an accurate scale for such illustration. Having in mind the exemplary thicknesses of the various exemplary thicknesses of the different panels and areas of the cover set forth above, it will be appreciated in FIGS. 2–6 that, for example, even though the covers 20 and 22 are substantially thicker than the securing panels 32, when the covers are attached to the book 10, the limited thickness of the cement 42 will account for some of the difference in thickness between panels 32 and cover panels 20 and 22.

In actuality, the matter of only a few thousandths of an inch difference in said thicknesses is practically indiscernible in the finished product when running one's hand or fingers around the portion of the cover extending across the spine of the book and along the hinged areas which flexibly connect the cover panels 20 and 22 to the securing panels 32. Further, particularly in view of the cement 42 being disposed between the inner surfaces of securing panels 32 and the adjacent sides of the book 10, said panels in conjunction with the back panel 26 form a substantially U-shaped channel of limited rigidity which encases the spine and narrow portions of the sides of book 10, while the cover panels 20 and 22 are free to be hinged to open position and in regard to which partially open positions are illustrated in phantom in exemplary manner in FIG. 2.

Figure 11:
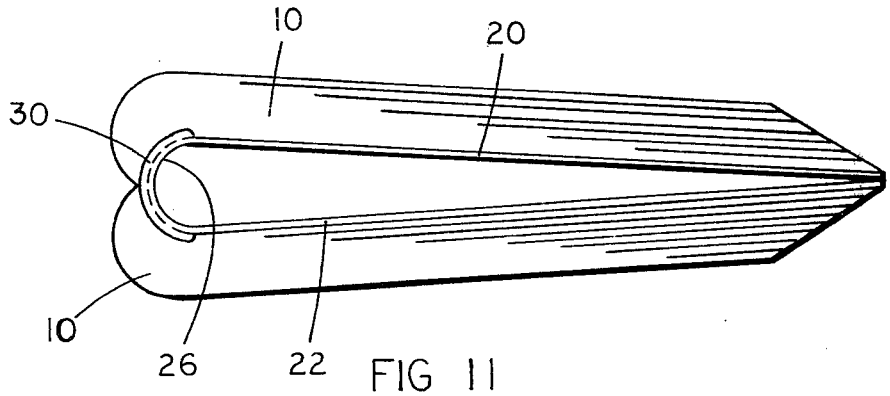
FIG. 11 is an end view of a book illustrated in fully opened condition in which two halves thereof are folded backward upon themselves.

The headbands 30 are illustrated as being of approximately the same thickness as the cover panels 20 and 22. This is merely exemplary. If desired, the thickness of the headbands 30 may be slightly less or greater than that which is illustrated. However, in view of the fact that the polyolefins which preferably are used for forming the book cover are relatively flexible, the limited thickness of the headbands 30 does not offer any undue impedence to bending or flexing the spine portion of the book, notwithstanding the fact that the headbands 30 are sufficiently thick to effectively strengthen the opposite ends of the back panel 26 in the manner described hereinabove. Accordingly, as shown in exemplary manner in FIG. 11, the book 10 may be opened to substantially any section thereof and the groups of pages at opposite sides of the opening made in the book may be folded substantially 180° apart from closed position so as to dispose the cover panels 20 and 22 in contact with each other, at least at the outer edges, without damaging the book in any way. This is due to the flexibility provided in the spine portion of the book, with the exception of books that are held together by means projected through the sides, because of the particular construction which has been utilized as described in detail above and also due to the firm attachment of the signatures to flexible back panel 26. By such an arrangement, the text or illustrations upoon the surfaces of the pages where the book has been opened may be held in flat condition in one hand of the user so as to expose either page in readily readable condition.

Figure 4:
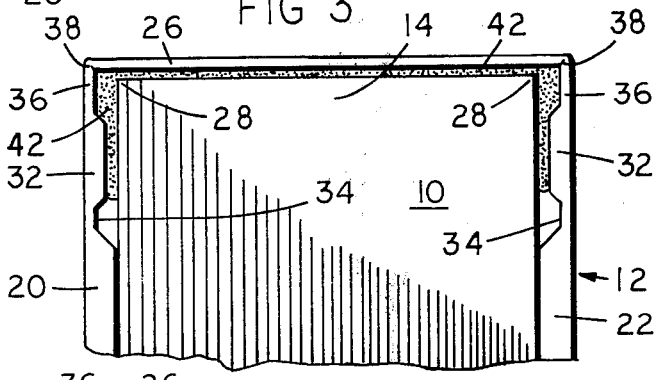
FIG. 4 is a view similar to FIGS. 2 and 3 but showing a cover in which the headbands have been omitted from the cover.
Figure 6:
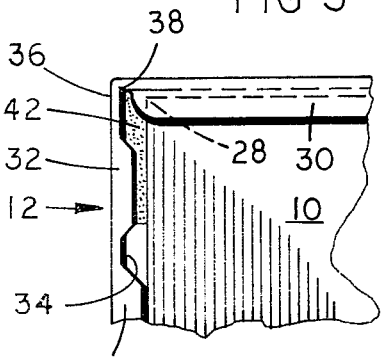

Referring to FIG. 4, it is possible to utilize the present invention in book construction in which the headbands 30 and/or corner projections 24 are omitted. Aside from such omission, all other elements and portions of the cover 12 and book 10 are substantially similar to the embodiments shown in the proceeding figures, as well as in FIGS. 5–9.

A slightly different embodiment of the invention shown in FIGS. 1–3 and 5–9 is shown in FIGS. 12 and 13 in which it will be seen that the headband 30 is molded on the opposite surface of the cover 12 from that upon which the thickened areas which form the cover panels 20 and 22, of which only panel 22 is shown, and the securing panel 32 are formed. When such embodiment of cover is applied to a book 10, as shown in FIG. 13, the substantially smooth surface of the cover 12 is disposed innermost against the spine 14 and the opposite sides of the book 10, whereas the flat, thickened projections which form the cover panels 20 and 22, as well as the securing panels 32 project outermost from the cover 12. This version of the cover also is secured to the spine and portions of the sides of the book 10 by cement 42, similarly to the manner in which cement secures the covers of the preceding embodiments to the book.

From the foregoing, it will be seen that the present invention provides a relatively simple but highly effective cover construction formed from appropriate synthetic resin of durable and flexible nature which may be affixed to the spine and portions of the sides of a book by the use of appropriate cement and requiring only very simple machines or apparatus to connect the covers to such book, thereby providing books covered with durable covers. Further, the construction accommodates an individual size of cover to a limited range of different thicknesses of books by the provision of the adjustment-providing land strips 36. Although such adjustment results in the outer edges of the cover panel projecting slightly different distances in individual books from the outer edges of the pages of the books, such variations in projection is practically unnoticeable, whereby no trimming of the outer edges is required.

The present invention also provides a book construction in which a neat, serviceable arrangement is provided between the book and the hinged covers by means which eliminate the need for installing an end sheet respectively between each cover panel and the first and last pages of the book as in conventional book construction and especially in books having so-called hard covers. Economy in manufacturing thus is achieved.

If desired, the headbands 30 may have serrated or somewhat crenelated outermost surfaces and thereby facilitate the adaptation of the cover 12 to books having curved spines, expecially curvatures of short radii, and particularly in the event it is desired that the headbands be reasonably thick for greater durability.

It also is to be understood that the cover structures of the present invention may be applied to magazines and periodicals, particularly those of a more permanent nature and of the relatively expensive type which, at present, are provided with bindings and covers which are more durable than conventional paper covers now used on magazines, thereby minimizing the cost of such publications or upgrading of conventional paper covers to a more durable product.

In addition to the advantages afforded by the invention as set forth above, another advantage is that by using covers formed from the types of synthetic resin described above, which primarily are thermoplastic, the outer surfaces of the cover panels 20 and 22, and/or the back panel 26, may be provided inexpensively with decorative embossing or textured surfaces, as well as raised or depressed designs, letters, numerals and the like. Further, it is possible to employ multi-colored resins affording a wide range of aesthetic effects. Laminates of various kinds may be formed by conventional methods and utilized in the covers for ornamental, as well as utilitarian effects.

Further, repair of badly damaged books of conventional construction, especially library and textbooks, is relatively costly and time-consuming, in addition to the results not always being very satisfactory. As long as the book per se, i.e., the connected pages, are relatively undamaged and only the cover panels and spine covering are loose or damaged, the book signatures may be removed from the covers and possibly re-glued or a new kraft strip applied across the spine. Then a cover of the present invention may be cemented onto the spine and along limited portions of the first and last pages as described hereinabove, to repair the book effectively for extensive additional life.

In the foregoing description, certain detailed procedures and processes have been described by which book covers comprising the present invention may be formed. In addition to those which are described above, there are a substantial number of additional processes by which book covers embodying the invention may be formed through the utilization of various machines and mechanisms.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. A unitary book cover formed from synthetic resin and adapted to be affixed to a book to cover the spine and provide hinged cover panels for books of different thicknesses within predetermined limits, said unitary cover being sheet-like and comprising cover panels of uniform thickness positioned at opposite ends of said cover and the inner edges of said cover panels being spaced apart by connecting means including a central intermediate back panel which is substantially thinner than said cover panels to render said back panel readily flexible to conform it for connection by adhesive to the spine of a book, said back panel having a width equal to the width of the thickest book of a limited range of thicknesses to which said cover is adapted to be affixed, the outermost portions of said back panel comprising lands and the thinness of said back panel adapting said lands thereby to be bent readily around the edges of books of less thickness than the width of said back panel so as to adapt said lands to be affixed by adhesive to limited portions of the outer pages of said book adjacent the spine thereof and thereby minimize the numbers of different sizes of covers necessary to be made to provide covers respectively for books of a limited range of thicknesses, the flexibility of said back panel also being great enough to minimize memory in said back panel to obviate tendencies to cause said land portions thereof when overlying sides of said book to open said book unintentionally, a portion of said connecting means immediately adjacent the inner edges of said cover panels being thinner than said cover panels and comprising hinge means for said cover panels, and headbands formed of the same material as said back panel and integral therewith adjacent opposite ends thereof on the surface to be affixed to the spine of the book, said headbands being substantially thicker than said back panel and shorter than the width of said back panel and the distance between the inner faces of said headbands being substantially equal to the length of the spine of said book and operable to interposition the spine of said book upon said cover accurately between said headbands when assembling the same.

2. The book cover according to claim 1 in which said lands are provided with score lines along the surfaces thereof which are adapted to engage the edges of a book to which said cover is to be attached, thereby minimizing the tendency of plastic memory in the material of said back panel to restore the panel to flat condition following attachment thereof to a book.

3. The book cover according to claim 1 further including narrow securing panels of limited width formed on said connecting means between said cover panel hinge means and said lands and parallel to each other, said securing panels being thicker than said back panel but of less thickness than said cover panels and adapted to have adhesive applied thereto for adherence and connection thereof to the sides of a book adjacent the edges of said spine.

4. The book cover according to claim 3 in which the outer surface of said cover initially is planar and said securing panels extending outwardly from the opposite surfaces of said cover beyond the adjacent surfaces of said lands and cover panel hinge means.

5. The book cover according to claim 1 in which said headbands are positioned on said intermediate back panel of said cover substantially centrally between opposite edges of said panel and the greater width of said panel than the length of said headbands providing latitude in bending said lands of said intermediate panel around the edges of the spines of books of said limited range of different thicknesses which are no less than the length of said headbands.

6. The book cover according to claim 1 further including an assembly of pages, means binding said pages together commonly along one edge to form a spine, said spine being positioned substantially centrally of said back panel of said book cover and the ends of said spine respectively being adjacent said inner faces of said headbands and thereby accurately position said bound pages relative to said back panel of said book cover, and adhesive applied between said spine and back panel to secure the same together and thereby form a completed book.

7. The structure according to claim 6 in which the lands of said back panel extend closely around the opposite edges of said spine of said connected pages and portions of said lands also respectively being secured by said adhesive to the outermost pages of said assembly of pages adjacent the edges of said pages adjacent said spine.

8. The structure according to claim 6 in which said connecting means between said cover panel hinge means and said lands include narrow securing panels which are thicker than said lands and are parallel to each other, and adhesive securing said securing panels respectively to the outer pages of said assembly of pages near the spine edges of said pages.

* * * * *